US005205541A

United States Patent [19]

Roberts et al.

[11] Patent Number: 5,205,541

[45] Date of Patent: Apr. 27, 1993

[54] ARROW HEAD EXTRACTOR

[76] Inventors: Joseph S. Roberts, 2066 Placida Rd, Englewood, Fla. 34224; George Spector, 233 Broadway RM 3815, New York, N.Y. 10007

[21] Appl. No.: 876,304

[22] Filed: Apr. 30, 1992

[51] Int. Cl.[5] ..... B66F 3/00

[52] U.S. Cl. ..... 254/131; 29/267

[58] Field of Search ..... 81/177.4; 254/131, 129, 254/130; 29/267

[56] References Cited

U.S. PATENT DOCUMENTS

| | | | |
|---|---|---|---|
| 873,625 | 12/1907 | Starrett | 81/177.4 |
| 2,212,716 | 8/1940 | Noble et al. | 254/131 |
| 2,940,167 | 6/1960 | Boyer et al. | 29/267 |
| 3,274,675 | 9/1966 | Jackson | 29/267 |
| 3,441,251 | 4/1969 | Barns | 29/267 |
| 3,779,515 | 12/1973 | Larios et al. | 254/131 |
| 3,826,471 | 7/1974 | Orton et al. | 254/131 |
| 4,488,706 | 12/1984 | Kono | 254/131 |
| 5,102,100 | 4/1992 | Troncoso | 254/131 |

*Primary Examiner*—Robert C. Watson

[57] ABSTRACT

An arrowhead extractor is provided for removing an arrowhead embedded into wood. The arrowhead has a threaded end while the extractor consists of a lever arm having a central portion pivotly attached to a support leg in which the foot of the support leg rests against the wood. A mechanism is attached adjacent an end of the lever arm for engaging with the threaded end of the arrowhead, whereby pivoting of the lever arm will cause the engaging mechanism to pull the arrowhead out of the wood.

3 Claims, 1 Drawing Sheet

ARROW HEAD EXTRACTOR

BACKGROUND OF THE INVENTION

The instant invention relates generally to tools and more specifically it relates to an arrowhead extractor.

Numerous tools have been provided in prior art that are adapted to remove arrows, rings and the like. For example, U.S. Pat. Nos. 3,826,471; 3,873,068 and 4,074,411 all are illustrative of such prior art. While these units may be suitable for the particular purpose to which they address, they would not be as suitable for the purposes of the present invention as heretofore described.

SUMMARY OF THE INVENTION

A primary object of the present invention is to provide an arrowhead extractor that will overcome the shortcomings of the prior art devices.

Another object is to provide an arrowhead extractor for withdrawing an arrowhead embedded in a tree, post and any other type of piece of wood.

An additional object is to provide an arrowhead extractor that utilizes a lever action which requires less strength than that required in attempting to remove the arrowhead by grasping and pulling it manually.

A further object is to provide an arrowhead extractor that is simple and easy to use.

A still further object is to provide an arrowhead extractor that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
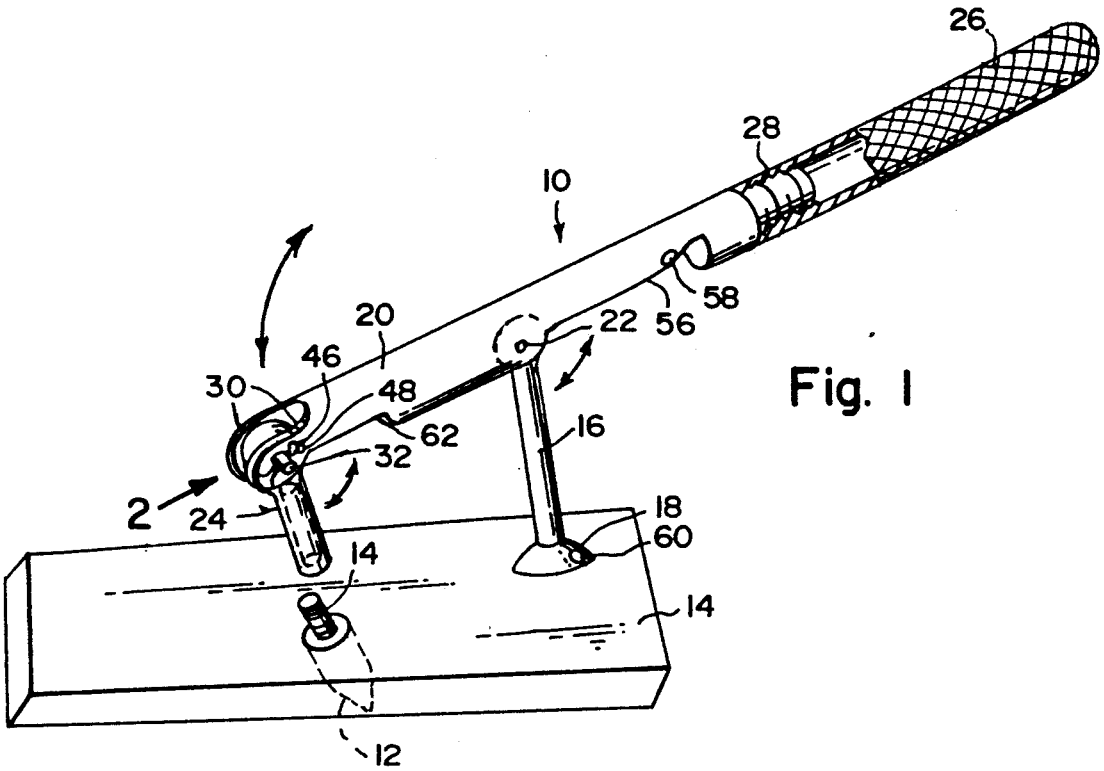
FIG. 1 is a perspective view of the invention with a detachable handle and being used to remove an arrowhead from a piece of wood.

Turning now descriptively to the drawings, in which similar reference characters denote similar elements throughout the several views, FIG. 1 illustrates a device 10 for removing an arrowhead 12 embedded into wood 14, such as a tree, post or the like. The arrowhead 12 has a threaded end 14 while the device 10 consists of a support leg 16 having a foot 18 at one end to rest against the wood 14. A lever arm 20 has a central portion that is pivotly attached at 22 to other end of the support leg 16. A mechanism 24 is attached adjacent an end of the lever arm 20 for engaging with the threaded end 14 of the arrowhead 12, whereby pivoting of the lever arm 20 will cause the engaging mechanism 24 to pull the arrowhead 12 out of the wood 14.

The device 10 further includes a hollow handle grip 26 detachable at 28 to the lever arm 20 so that a person (not shown) may store small items therein.

Figure 2:
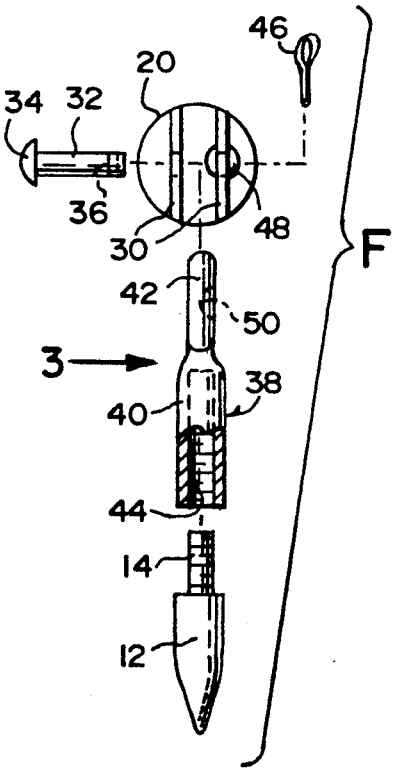
FIG. 2 is an exploded end view showing the penny screw partly in section, pivot pin, cotter pin and arrowhead in greater detail.
Figure 3:
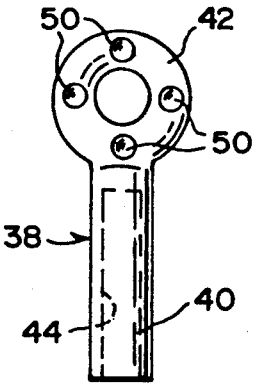
FIG. 3 is a side view of the penny screw as indicated by arrow 3 in FIG. 2.

As best seen in FIGS. 2 and 3, the engaging mechanism 24 includes the lever 20 having a forked end 30. A pivot pin 32 which has a head 34 at one end and a transverse hole 36 at other end is provided. The pivot pin 32 is mounted between the furcations of the forked end 30. An engagement member 38 being a hollow shank 40 with an eye head 42 rotates on the pivot pin 32. The shank 40 has internal threads 44 to engage with the threaded end 14 of the arrowhead 12. A cotter pin is disposed within the transverse hole 36 in the pivot pin 32 to retain the engagement member 38 thereto.

A ball bearing 48 is mounted into one of the furcations of the forked end 30. The eye head 42 has four indentations 50 spaced at 90° positions thereabout so that anyone of the indentations 50 can bear against the ball bearing 48 to hold the engagement member 38 in a stable position.

Figure 4:
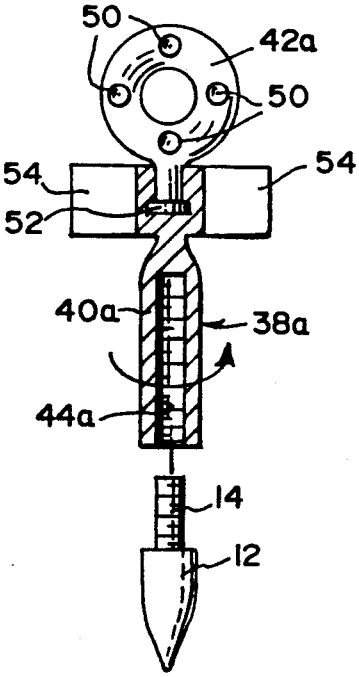
FIG. 4 is a side view of a modified penny screw in which the shaft turns while the eyelet is stationary on the lever and with the threaded end of the arrowhead ready to be attached thereto.

FIG. 4 shows a modified engagement member **38*a* being a hollow shank 40*a* swivelly connected at 52 to an eye head 42*a* which rotates on the pivot pin 32. The shank 40*a* has a pair of wings 54 and internal threads 44*a* to engage with the threaded end 14** of the arrowhead when the wings are manually turned.

As shown in FIG. 1, the lever arm 20 can have a bottom recess 56 adjacent pivot 22 and a ball bearing 58 in the recess 56. The foot 18 of support leg 16 can have an indentation 60 so that the support leg 16 and foot 18 can swing up into the recess 56 when not in use and be held therein by the indentation 60 bearing against the ball bearing 58. Another recess 62 can be provided in the lever arm 20 so that the engagement member **38/38*a* can swing up into the recess 62 when not in use and be held therein by one of the indentations 50 bearing against the ball bearing 48**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for removing an arrowhead embedded into wood, the arrowhead having a threaded end, said device comprising:

a) a support leg having a foot at one end to rest against the wood;

b) a lever arm having a central portion pivotly attached to other end of said support leg;

c) means attached adjacent an end of said lever arm for engaging with the threaded end of the arrowhead, whereby pivoting of said lever arm will cause said engaging means to pull the arrowhead out of the wood, further including a hollow handle grip detachable to said lever arm so that a person may store small items therein; wherein said engaging means includes:

d) said lever having a forked end;

e) a pivot pin having a head at one end and a transverse hole at other end, said pivot pin mounted between the bifurcations of said forked end;

f) an engagement member being a hollow shank with an eye head which rotates on said pivot pin, said shank having internal threads to engage with the threaded end of the arrowhead;

g) a cotter pin disposed within said transverse hole in said pivot pin to retain said engagement member thereto; further including:

h) a ball bearing mounted into one of the furcations of the forked end; and i) said eye head having four indentations spaced at 90° positions thereabout so that any one of said indentations can bear against said ball having to hold said engagement member in a stable position.

2. A device as recited in claim 1, wherein said engaging means includes:

a) said lever having a forked end;

b) a pivot pin having a head at one end and a transverse hole at other end, said pivot pin mounted between the bifurcations of said forked end;

c) an engagement member being a hollow shank swivelly connected to an eye head which rotates on said pivot pin, said shank having a pair of wings and internal threads to engage with the threaded end of the arrowhead when said wings are manually turned; and d) a cotter pin disposed within said transverse hole in said pin to retain said engagement member thereto.

3. A device as recited in claim 2, further including:

a) a ball bearing mounted into one of the furcations of the forked end; and b) said eye head having four indentations spaced at 90° positions thereabout so that any one of said indentations can bear against said ball bearing to hold said engagement member in a stable position.

* * * * *